US005876214A

United States Patent [19]

McHugh et al.

[11] Patent Number: 5,876,214

[45] Date of Patent: Mar. 2, 1999

[54] GROUNDING STRUCTURE FOR USE WITH CARD EDGE CONNECTOR

[75] Inventors: Robert G. McHugh, Evergreen, Colo.; Hsiang-Ping Chen, Taipei Hsien, Taiwan

[73] Assignee: Hon Hai Precision Ind. Co., Ltd., Taipei Hsien, Taiwan

[21] Appl. No.: 777,551

[22] Filed: Dec. 30, 1996

[51] Int. Cl.[6] ..... H01R 9/09

[52] U.S. Cl. ..... 439/60; 439/108; 439/637

[58] Field of Search ..... 439/60, 108, 637, 439/733.1

[56] References Cited

U.S. PATENT DOCUMENTS

| | | | |
|---|---|---|---|
| 4,089,581 | 5/1978 | Schwindt | 439/637 |
| 4,996,766 | 3/1991 | Piorunneck et al. | 439/637 |
| 5,112,231 | 5/1992 | Harwath et al. | 439/60 |
| 5,259,772 | 11/1993 | Fusselman et al. | 439/108 |
| 5,403,215 | 4/1995 | Buchter et al. | 439/733.1 |
| 5,522,737 | 6/1996 | Brunker et al. | 439/637 |
| 5,634,819 | 6/1997 | Pan et al. | 439/637 |
| 5,785,556 | 7/1998 | Pratt et al. | 439/637 |

*Primary Examiner*—Neil Abrams
*Assistant Examiner*—Brian J. Biggi

[57] ABSTRACT

A card edge slot connector includes an insulative housing defining a central slot for receiving a card therein with a plurality of passageways disposed therein by two sides of the central slot. A corresponding number of signal contacts are received within the passageways, respectively. At least an elongated grounding member is disposed in the inner portion of the housing with a series of grounding straps extending from the grounding member into the corresponding passageways, respectively, wherein each grounding strap shares the same passageway with the corresponding signal contact.

12 Claims, 6 Drawing Sheets

GROUNDING STRUCTURE FOR USE WITH CARD EDGE CONNECTOR

BACKGROUND OF THE INVENTION

1. Field of The Invention

The invention relates to card edge connectors with grounding devices, and particularly to the card edge connector with signal contacts and grounding contacts for engagement with a card received in the connector and with a mother board on which the connector is mounted.

2. The Related Art

U.S. Pat. No. 5,051,099 discloses a high speed card edge connector having signal contact members and ground contact members wherein the ground contact member is spaced both vertically and horizontally from the associated contact section of the signal contact member whereby the contact section of the signal contact member will not engage grounding means on the inserted card.

The disadvantages of the aforementioned prior patent, includes using a single ground contact member corresponding each pair of signal contact members in a transverse plane. The blanked or stamped ground contact member uses too much material on a row carrier, so it is not economic enough. Additionally, the stamped ground contact member should be installed or inserted into the housing of the connector one by one, so it takes time and complicates the manufacturing process. Moreover, the simplex type ground contact member is relatively small the thin, so it tends to create inductance resulting in grounding bounces and noises, thus precluding the efficient true signal transmission.

Therefore, an object of the invention is to provide a high speed card edge connector having a grounding device which is adapted to be easily installed and to obtain the reliable and good grounding effect.

SUMMARY OF THE INVENTION

According to an aspect of the invention, a card edge connector includes an insulative housing defining a central slot for receiving a card therein with a plurality of passageways disposed therein by two sides of the central slot. A corresponding number of signal contacts are received within the passageways, respectively. At least an elongated grounding member is disposed in the inner portion of the housing with a series of grounding straps extending into the corresponding passageways, respectively, wherein each grounding strap shares the same passageway with the corresponding signal contact.

DETAILED DESCRIPTION OF THE PREFERRED EMBODIMENTS

Figure 1:
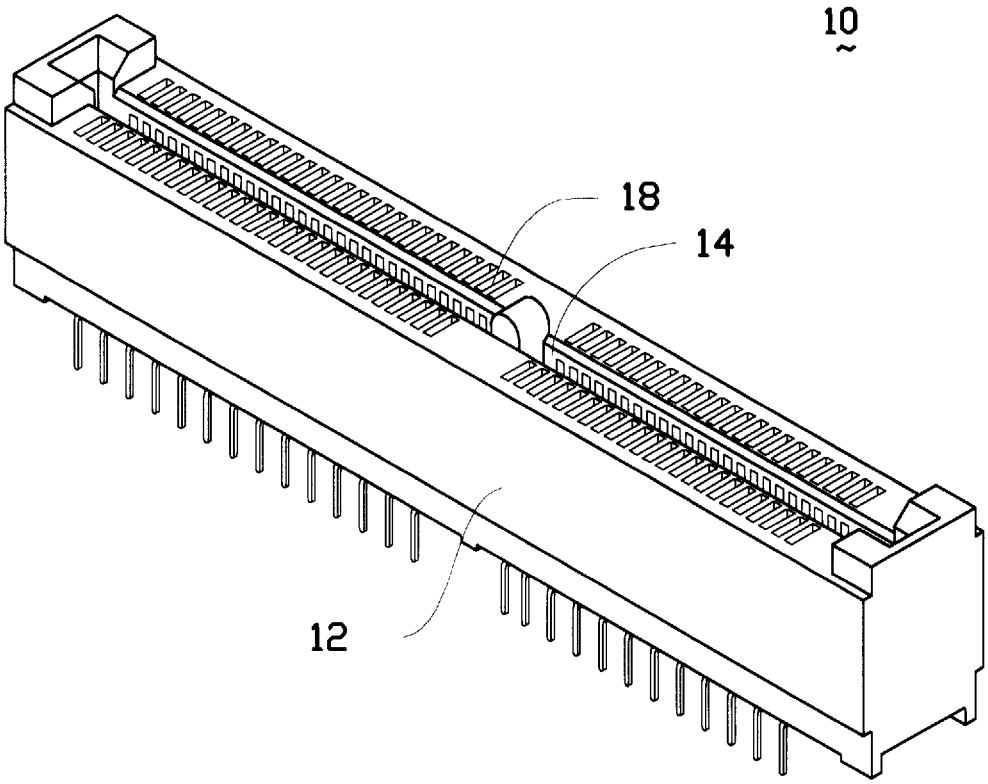
FIG. 1 is a perspective view of a presently preferred embodiment of a high speed card edge connector, according to the invention.
Figure 2:
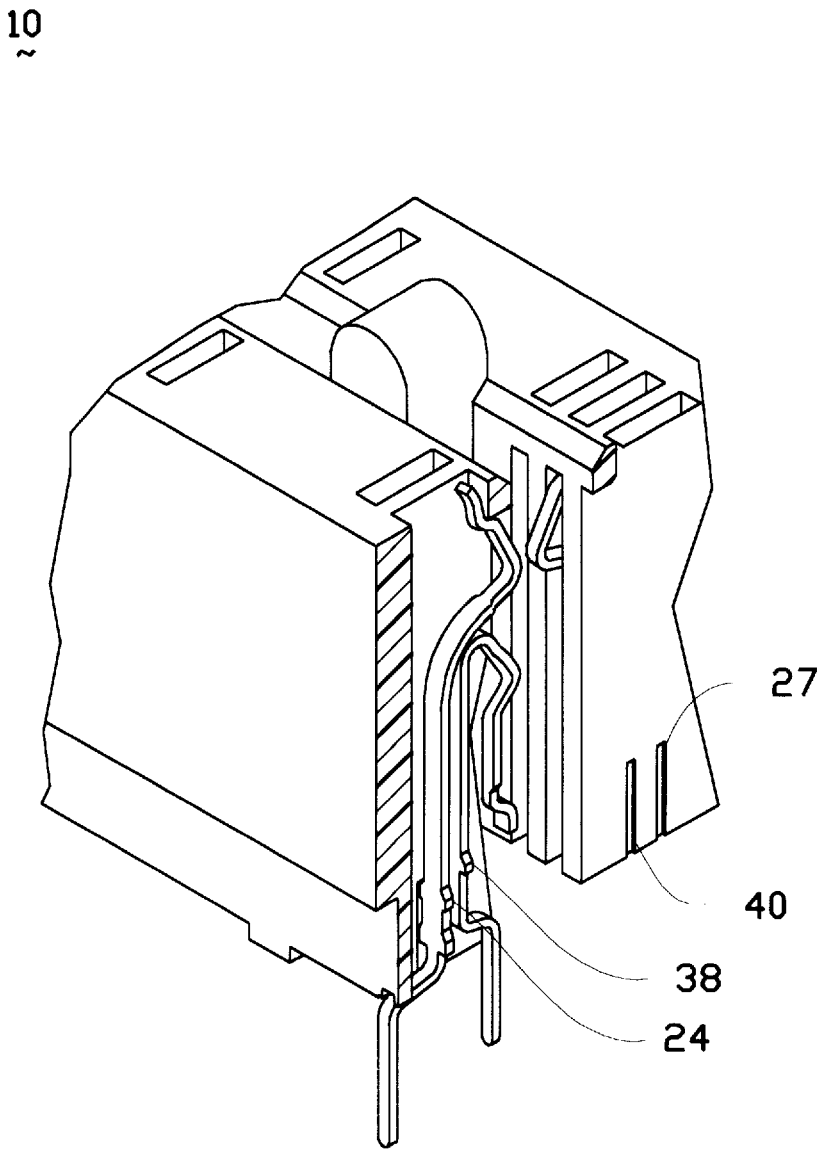
FIG. 2 is a partially fragmentary exploded perspective view of the housing of the connector of FIG. 1 to show the structures of the slit and the shallow in the housing aside the passageway for interferential engagement with the barbs of the signal contact and the barbs of the grounding strap, respectively.
Figure 3:
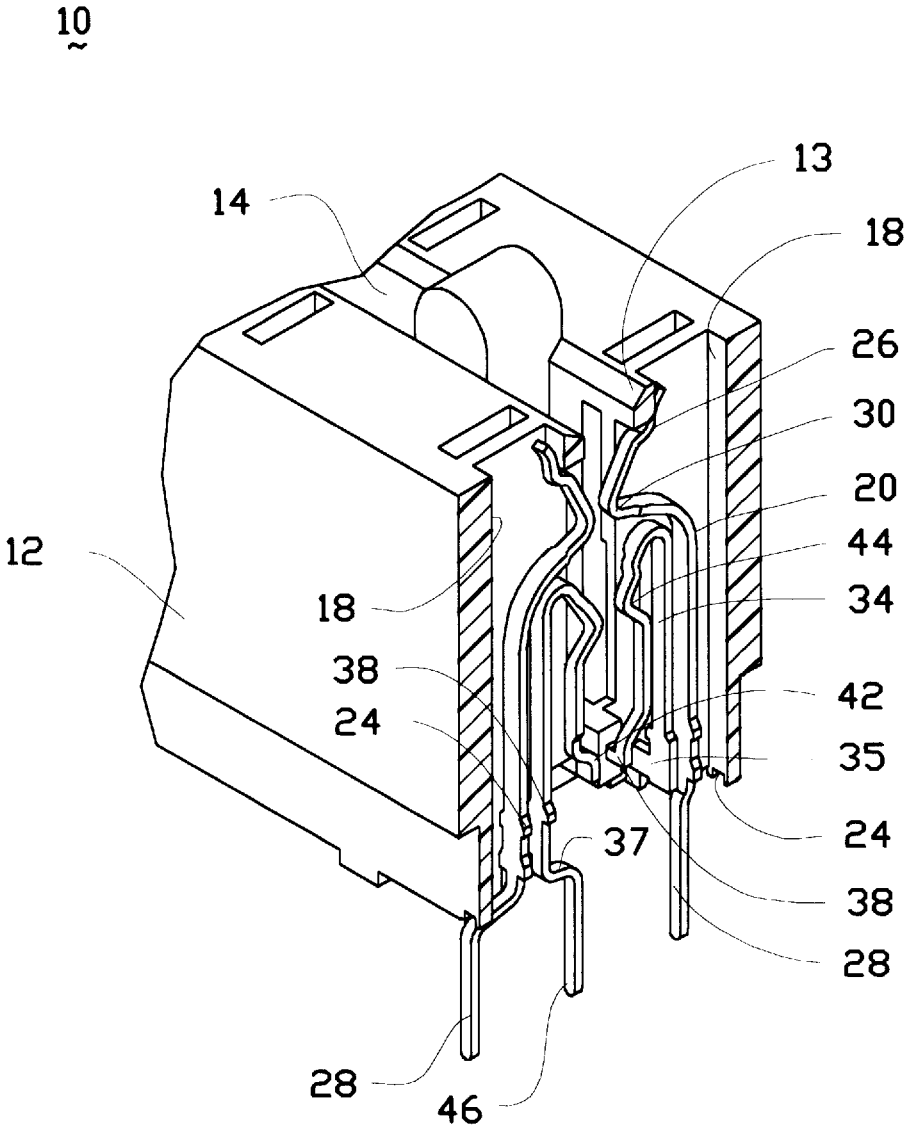
FIG. 3 is a fragmentary perspective view of the assembled connector of FIG. 1.

References will now be in detail to the preferred embodiments of the invention. While the present invention has been described in with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

It will be noted here that for a better understanding, most of like components are designated by like reference numerals throughout the various figures in the embodiments. Attention is directed to FIGS. 1–6 wherein a card edge connector 10 includes an insulative housing 12 defining a central slot 14 for receiving a card 16 therein with a plurality of passageways 18 disposed therein by two sides of the central slot 14.

Figure 4:
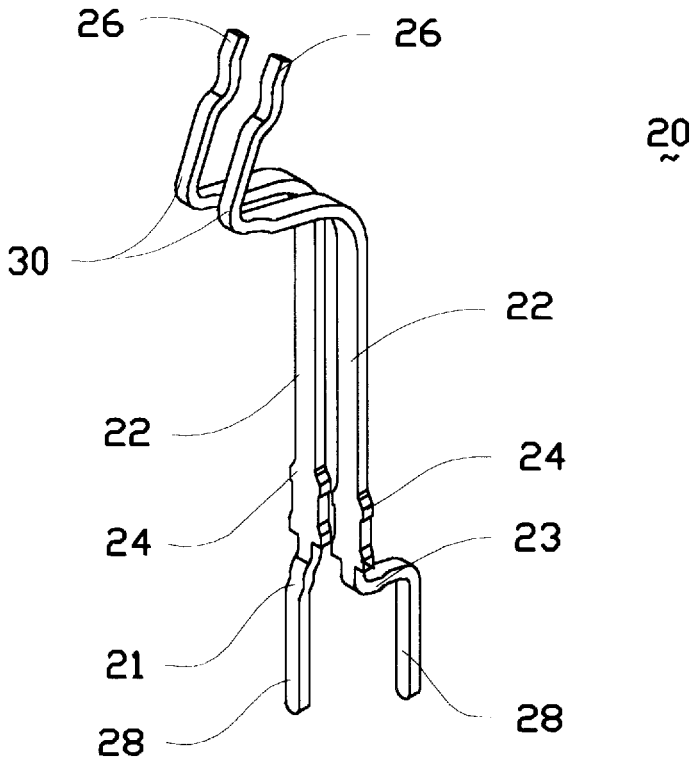
FIG. 4(A) is an enlarged perspective view of the signal contacts of FIG. 1.
FIG. 4(B) is an enlarged perspective view of the grounding member of FIG. 1.
Figure 4:
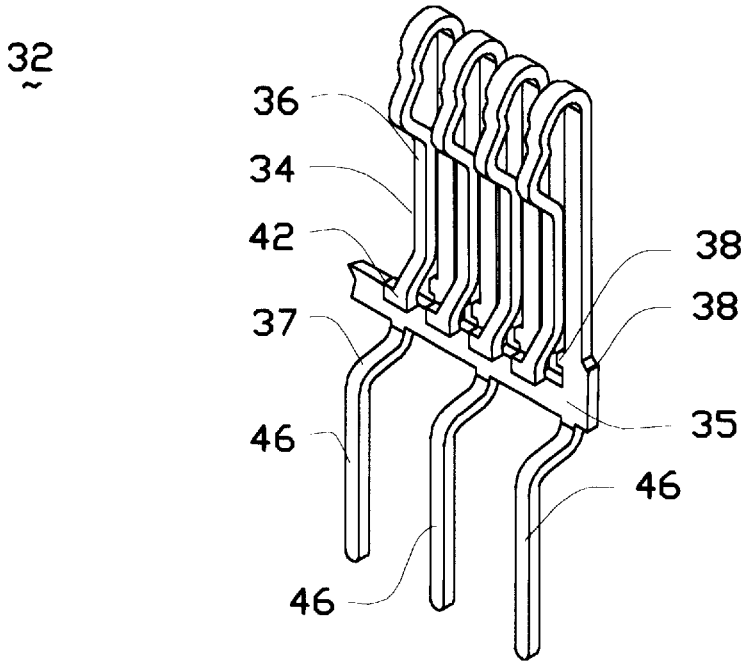
Figure 5:
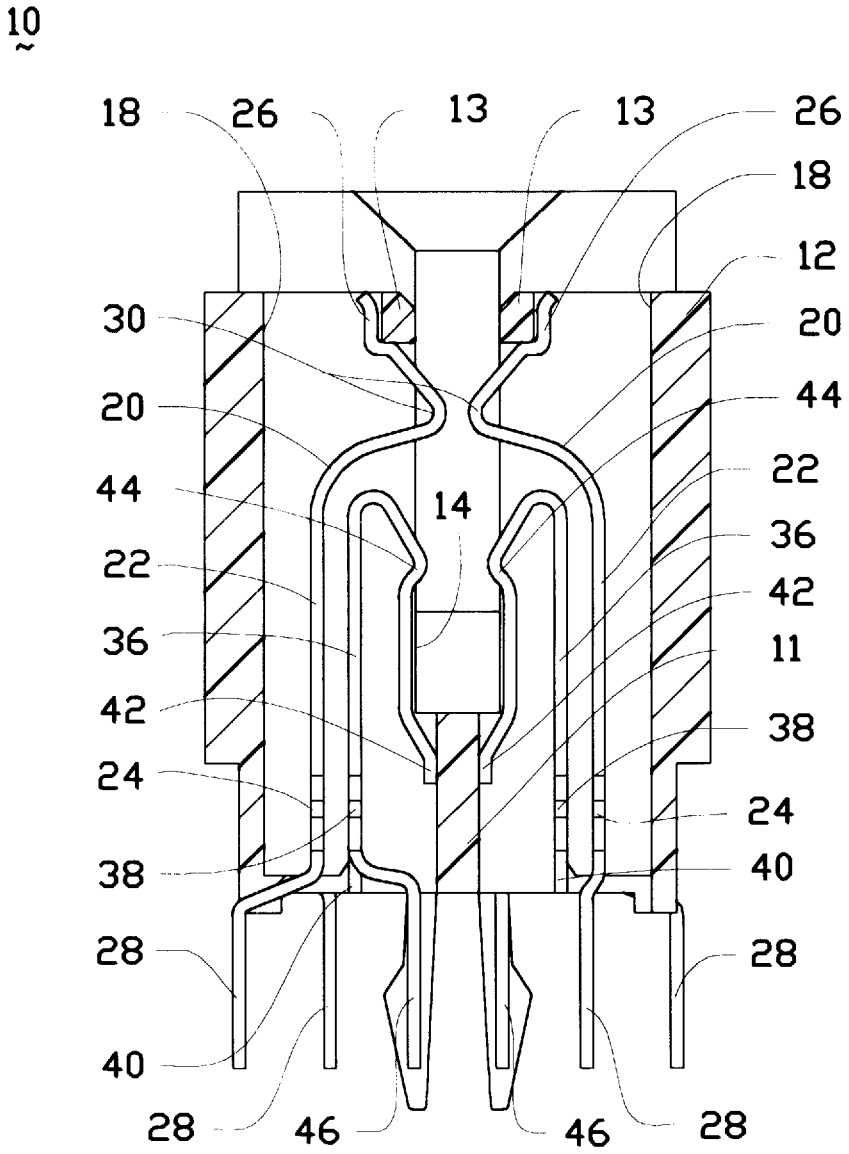
FIG. 5 is a cross-sectional view of connector of FIG. 1.

A corresponding number of signal contacts 20 are received within the passageways 18, respectively, wherein each signal contact 20 includes a main body 22 having retention barbs 24 on two sides thereof for interferential engagement within a pair of slits 27 beside the corresponding passageway 18, and an engagement section 26 at the distal end for engagement with the upper block 13 of the housing 12 in the passageway 18 for preloading consideration, referring to FIGS. 4 and 5. The signal contact 20 further includes a tail section 28 positioned below the main body 22 and an contact section 30 positioned between the main body 22 and the engagement section 26 for engagement with the signal circuit pad on the inserted card (not shown).

Referring to FIGS. 4 and 5, a grounding member 32 is disposed in the inner portion of the housing 12 by each side of the central slot 14 wherein a series of grounding straps 34 extend into the corresponding passageways 18, respectively. Each grounding strap 34 includes a main body 36 with barbs 38 on two sides for interferential engagement within a pair of shallows 40 in the corresponding passageway 18, and an engagement section 42 at the distal end for engagement with a central rib section 11 of the housing 12 for preloading consideration. A contact section 44 is positioned between the main body 36 and the engagement section 42 for engagement with the grounding circuit pad on the inserted card.

Figure 6:
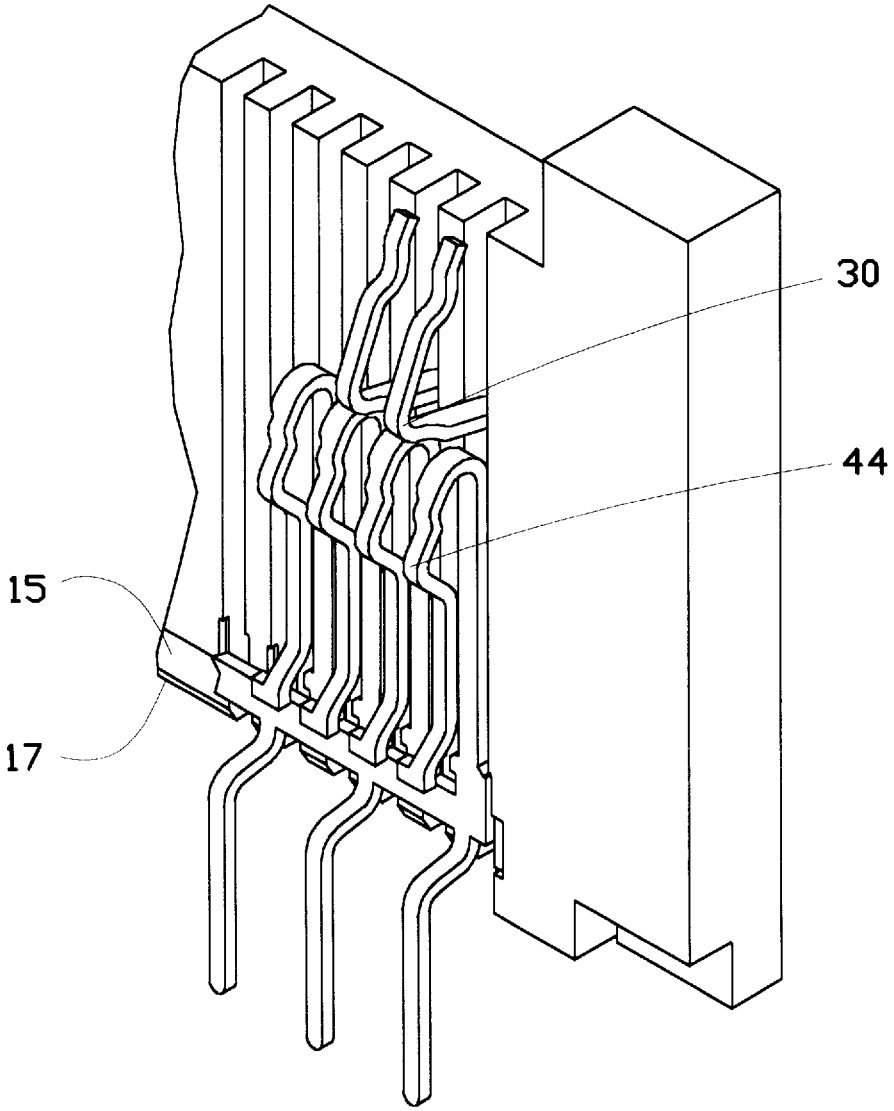
FIG. 6 is a partial cut-away perspective view of the housing of the connector to show the signal contact and the grounding strap in the passageway by the slot.

In this embodiment, a tail section 46 extends downward on every two grounding straps 34 for compliance with the holes in the mother board (not shown) on which the connector 10 is mounted. It can be understood that the tail section 46 can be arranged to extend downward on every more than two straps 34 if the mother board has less holes for grounding circuits. It is also seen that to receive the carrier section 35 of the grounding member 32 in the housing 12, the housing 12 comprises an elongated narrow recession 15 extending upward from the bottom surface 17 by each side of the central slot 14 (FIG. 6).

Referring to FIGS. 3, 4(A), 4(B) and 5, each pair of the signal contact and the grounding strap 34 in the same passageway 18 are laterally offset with each other on their respective contact sections 30, 44 in the horizontal direction because of lateral offset arrangement of the signal and grounding circuit pads on the inserted card (not shown). Similarly, each pair of signal contact 20 and grounding strap 34 are arranged in a high level and a low level, respectively, for compliance with two rows of signal circuit pads and grounding circuit pads on the inserted card (not shown).

It is contemplated that the unitary grounding member 32 having the carrier section 35 with its associated plural straps 34 adapted to be received within the respective passageways 18, allows one time installation into the housing 12 if the pitch of the straps 34 is designedly set to be equal to that of the passageways 18 of the housing 12. This will be much more advantageous than the plural small stamped ground contact members of the prior art connector as shown in the aforementioned U.S. Pat. No. 5,051,099. This carrier arrangement also saves the material than the stamped members of the prior art connector. The forming type straps 34 also provide superior resiliency than the stamped type ground member of the prior art. Because both of the signal contacts 20 and the grounding straps 34 are of a forming type, the main body 22 of the signal contact 20 and the main body 36 of the grounding strap 34 are easily and intentionally arranged in a parallel relationship after the signal contact 20 and the grounding member 32 have been completely installed within the housing by means of predetermined preloading control of the engagement sections 26, 42 of the signal contact 20 and the grounding strap 34 with regard to the housing 12. From an electrical viewpoint, this mutually vertical parallel arrangement provides a stable and predictable signal transmission in comparison with the angular extension of the signal and ground members in the prior art connectors.

It is appreciated that in this embodiment, the mother board defines six rows of staggered holes therein for receiving the corresponding tail sections 28 of the signal contacts 20 and the tail sections 46 of the grounding member 32. For each transverse plane along the longitudinal housing 12, there are a pair of tail sections 28 of two opposite signal contacts 20 in the opposite passageways 18, and a tail section 46 of the grounding member 32 wherein the tail section 46 is generally positioned at the mid-point of these two tail sections 28 of the opposite signal contact 20. As shown in FIGS, 3, 4(A), 4(B) and 5, for each transverse plane along the longitudinal housing 12, one tail section 28 of the signal contact 20 has a larger outward offset 21 and one tail section 28 of another signal contact 20 has a small inward offset 23, and the grounding strap 34, which is in the same passageway 18 with the signal contact 18 having the large outward offset 23, has an inward offset 37 extending toward the central slot 14 on its tail section 46. In an overall viewpoint, each grounding member 32 has plural tail sections 46, (in this embodiment, one for every adjacent two grounding straps 34), each has an inward offset extending toward the central slot 14.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, person of ordinary skill in this field are to understand that all such equivalent structures are to be included within the scope of the following claims.

We claim:

1. A high speed card edge connector comprising:

an insulative housing defining a central slot for receiving a card therein, a central rib section below the central slot and a number of passageways disposed by two sides of the central slot;

a corresponding number of signal contacts received within the passageways, respectively; and at least one grounding member positioned by one side of the central slot, said grounding member including a carrier section, a number of grounding straps commonly extending from the carrier section into all of the passageways by the corresponding side of the central slot, wherein each of said grounding straps includes a first main body having first barbs thereon, a first engagement section positioned at a distal end thereof and preloaded to engage with the central rib section, and a first contact section positioned between the first main body and the first engagement section.

2. The connector as defined in claim 1, wherein the housing further defines a number of upper blocks in the passageways, respectively, and each of the signal contacts has a second main body with second barbs thereon, a second engagement section positioned at a distal end thereof and preloaded to engage with a corresponding one of the upper blocks, a second contact section positioned between the second main body and the second engagement section, and a second tail section extending downward out of a bottom surface of the housing.

3. The connector as defined in claim 2, wherein the signal contact and the grounding strap in the same passageway have their first and second main bodies respectively extending vertically in said passageway and parallel to each other.

4. The connector as defined in claim 2, wherein the first contact section of the grounding strap and the second contact section of the signal contact in the same passageway are spaced from each other in both vertical and horizontal directions.

5. The connector as defined in claim 2, wherein the signal contacts can be divided into a first group with second tail sections inner offset from the second main bodies and a second group with second tail sections outer offset from the second main bodies, and wherein the grounding member further includes a number of first tail sections extending downward beyond the bottom face of the housing from the passageways receiving the second group of signal contacts.

6. A high speed card edge connector, comprising:

an insulative housing defining a central slot for receiving a card therein and a plurality of passageways disposed by two sides of the central slot;

a corresponding number of signal contacts received within the passageways, respectively; and at least one grounding member positioned by one side of the central slot, said grounding member including a carrier section, a number of grounding straps commonly extending upwardly from the carrier section into all of the passageways by the corresponding side of the central slot and a number of tail sections commonly extending downwardly from the carrier section to a location outside a bottom face of the housing, wherein the number of tail sections is less than the number of grounding straps.

7. The connector as defined in claim 6, wherein said tail sections all have respective offsets toward the central slot.

8. The connector as defined in claim 6, wherein the number of the tail sections is equal to half the amount of grounding straps.

9. The connector as defined in claim 6, wherein the number of the tail sections is equal to less than half the amount of grounding straps.

10. A grounding member for use with a high speed card edge connector including an insulative housing defining a number of passageways for receiving a corresponding number of signal contacts therein, a central slot between the passageways for receiving a card therein, and a central rib section below the central slot, said grounding member comprising:

an elongated carrier section;

more than two grounding straps commonly extending upward from the carrier section at equal intervals each of which is generally equal to a pitch of said passageways wherein each of said grounding straps includes a first main body having first barbs thereon, a first engagement section at a distal end thereof for engaging with the central rib section by a preloading acting on the engagement section when the grounding member is mounted to the housing of the connector, and a first contact section positioned between the first main body and the first engagement section.

11. The grounding member as defined in claim 10, wherein at least two tail sections commonly extend downward from a bottom surface of the carrier section.

12. The grounding member as defined in claim 11, wherein said tail sections, contact sections and engagement sections are offset from the corresponding main body in a same direction.

* * * * *